US006010128A

United States Patent [19]

Loser et al.

[11] Patent Number: 6,010,128

[45] Date of Patent: Jan. 4, 2000

[54] DEVICE FOR GUIDING A PAPER SHEET ON A BELT

[75] Inventors: Hans Loser, Langenau; Joachim Henssler, Ravensburg; Karl Steiner, Herbrechtingen, all of Germany

[73] Assignee: Voith Sulzer Papiermaschinen GmbH, Heidenheim, Germany

[21] Appl. No.: 08/958,198

[22] Filed: Oct. 27, 1997

[30] Foreign Application Priority Data

Oct. 30, 1996 [DE] Germany ..... 196 43 814

[51] Int. Cl.[7] ..... B65H 29/24; B65H 29/54

[52] U.S. Cl. ..... 271/276; 271/195; 271/196; 271/310; 198/493; 198/836.2

[58] Field of Search ..... 271/276, 195, 271/194, 310; 226/95, 97.3; 242/615.11; 198/493, 836.2

[56] References Cited

U.S. PATENT DOCUMENTS

| | | | |
|---|---|---|---|
| 4,551,203 | 11/1985 | Eskelinen . | |
| 4,692,215 | 9/1987 | Kerttula . | |
| 4,809,445 | 3/1989 | Meyer et al. . | |
| 5,022,166 | 6/1991 | Nguyen et al. | 226/97 |
| 5,046,712 | 9/1991 | Clapp et al. | 271/310 |
| 5,183,251 | 2/1993 | Sardella | 271/195 |

FOREIGN PATENT DOCUMENTS

| | | |
|---|---|---|
| 2602606 | 7/1977 | Germany . |
| 3339044 | 5/1984 | Germany . |
| 3524006 | 2/1986 | Germany . |
| 3706541 | 9/1988 | Germany . |
| 97/38163 | 10/1997 | WIPO . |

*Primary Examiner*—William E. Terrell
*Assistant Examiner*—Mark A. Deuble
*Attorney, Agent, or Firm*—Greenblum & Bernstein, P.L.C.

[57] ABSTRACT

Device for guiding a paper sheet on a belt that includes first air guidance surfaces located on a paper sheet guiding side of the belt. The first air guidance surfaces may be positioned to create a dynamic pressure between the first air guidance surfaces and the paper sheet and to press the paper sheet into the belt.

25 Claims, 1 Drawing Sheet

DEVICE FOR GUIDING A PAPER SHEET ON A BELT

CROSS-REFERENCE TO RELATED APPLICATION

The present application claims priority under 35 U.S.C. § 119 of German Patent Application No. 196 43 814.4 filed Oct. 30, 1996, the disclosure of which is expressly incorporated by reference herein in its entirety.

BACKGROUND OF THE INVENTION

1. Field of the Invention

The present invention relates to a device for guiding a paper sheet on a belt, e.g., a felt belt, to reduce sheet flutter.

2. Discussion of Background Information

In paper manufacturing, a paper sheet is guided on many belts in a machine, e.g., on a screen of a screen section, on either felted belts or smooth belts in a press section, and on a dryer screen in a dryer section.

Further, in parts of the machine in which the paper sheet is still very wet, the sides of the paper sheet tend to flutter, particularly at the high sheet run velocities utilized in the art. This flutter is generally attributable the low stability exhibited by the still wet paper sheet. This fluttering is undesirable since it can lead to operational disturbances and to a reduction in sheet quality.

SUMMARY OF THE INVENTION

Therefore, the present invention provides a device for guiding a paper sheet on a belt in a paper sheet production machine. In accordance with the present invention, fluttering of the side areas of the paper sheet is substantially avoided.

The present invention provides an arrangement of first air guidance surfaces positioned on a side of the belt carrying the paper sheet. In this manner, a dynamic pressure may be formed or created between the first air guidance surfaces and the paper sheet due to the entrained air, i.e., the air being pulled along with the moving paper sheet, pressing the paper sheet against the belt.

Because the air being pulled along with the paper sheet may be utilized to press the paper sheet onto the belt, a tendency to flutter may be reduced. The device in accordance with the present invention may be formed in a particularly simply manner and does not require any additional expenditure of energy. Thus, wherever fluttering of the paper sheet sides might be anticipated, air guidance surfaces may be suitably positioned to reduce the fluttering tendency.

In accordance with another embodiment of the invention the air guidance surfaces may be positioned on both edges of the paper sheet so that the air pulled along by the paper sheet may be deflected laterally to the outside to simultaneously create a dynamic pressure to press the paper sheet onto the belt.

Since the entrained air may be deflected to flow diagonally outward over the edges of the paper sheet, the press effect may be enhanced. That is, fluttering tendencies of the paper sheet edges may be substantially reduced. This deflection may be provided by extending the air guidance surfaces diagonally and toward the paper sheet in the sheet run direction, and diagonally outward in a direction of the edges of the paper sheet. Thus, the air guidance surfaces may preferably cover the edges of the paper sheet.

In this manner, particularly advantageous air guidance may be achieved so as to reduce the fluttering tendencies of the paper sheet, in particular, the edge areas.

In another embodiment of the present invention, second air guidance surfaces may be located on a side of the belt opposite the paper sheet carrying side to outwardly deflect the entrained air, i.e., the air being pulled along with the belt. This deflection of the air on the underside of the belt may create of form a vacuum for further suctioning the paper sheet to the belt. Therefore, guidance of the paper sheet on the belt may be additionally stabilized.

The second air guidance surfaces may be extended in the run direction of the sheet and diagonally outwards from the belt and in a direction of the edges of the belt.

The first and second air guidance surfaces may be selectively positioned either opposite one another or alternatingly with the paper sheet side and the belt guided therebetween.

In addition, the present invention contemplates positioning air guidance surfaces at suitable locations on one side or the other of the belt depending upon the local structural conditions.

In accordance with another embodiment of the present invention, third air guidance surfaces may be positioned on the paper sheet side extending outwardly in the sheet run direction in a vicinity in which paper sheet is to be transferred to a subsequent unit. In this manner, a suction directed outward from the paper sheet may be created or formed to facilitate a transfer of a transfer strip of the paper sheet to the subsequent unit or to support the edges of the paper sheet during transfer to another unit.

In an additional embodiment of the present invention, the air guidance surfaces may include curved surfaces.

Accordingly, the present invention may reduce flow losses during the deflection of the entrained air with the paper sheet or the belt, and, therefore, enhance the desired dynamic pressure or the desired suction effect. The curvature of the air guidance surface may, of course, be optimally adjusted with regard to the flow.

It is understood that the features of the present invention, as explained above and as more fully discussed below, can not only be used in the specified combination, but may also be used in different combinations or alone without departing from the scope of the invention.

Accordingly, the present invention is directed to a device for guiding a paper sheet on a belt, the device including first air guidance surfaces located on a paper sheet guiding side of the belt. The first air guidance surfaces may be positioned to create a dynamic pressure between the first air guidance surfaces and the paper sheet and to press the paper sheet into the belt.

In accordance with a further feature of the present invention, the first air guidance surfaces may be positioned adjacent edges of the paper sheet to outwardly deflect air being pulled along by the paper sheet and to press the paper sheet onto the belt.

In accordance with another feature of the present invention, the first air guidance surfaces may be positioned to extend diagonally toward the paper sheet in a sheet run direction and diagonally outward toward edges of the belt.

In accordance with still another feature of the present invention, the air guidance surfaces may be extended over an edge of the paper sheet.

In accordance with a still further feature of the present invention, second air guidance surfaces may be located on an other side of the belt opposite the paper sheet guiding side. The second air guidance surfaces may be positioned to outwardly deflect air being pulled along by the other side of the belt and to create a vacuum to suction the paper sheet onto the belt. Further, the second air guidance surfaces may be positioned to extend outwardly from the other side of the belt in a sheet run direction and diagonally to edges of the belt.

In accordance with another feature of the present invention, the first and second air guidance surfaces may be positioned opposite each other another.

In accordance with still another feature of the present invention, the first and second air guidance surfaces may be alternatingly positioned along the belt.

In accordance with a further feature of the present invention, third air guidance surfaces may be located on the paper sheet guiding side of the belt in a vicinity of an area for transferring the paper sheet to a subsequent unit. The third air guidance surfaces may be positioned to extend from the paper sheet in a sheet run direction.

In accordance with a still further feature of the present invention, the first, second, and third air guidance surfaces may include curved surfaces.

In accordance with yet another feature of the present invention, the belt may be a felt belt.

The present invention is also directed to a flutter avoidance device for use in a machine in which a paper sheet is guided on a moving belt. The belt may have a first surface for guiding the paper sheet and a second surface opposite the first surface. The device may include a first dynamic pressure device exerting a dynamic pressure that presses the paper sheet onto the first surface of the belt.

In accordance with another feature of the present invention, the first dynamic pressure device may be positioned adjacent the first surface. Further, the first dynamic pressure device may include air guidance surfaces positioned to divert entrained air carried by the first surface toward the first surface and outwardly over an area adapted for guiding the paper sheet. The air guidance surfaces may have a curved surface.

In accordance with a further feature of the present invention, a second dynamic pressure device may be positioned adjacent the second surface. Further, the second dynamic pressure device may include air guidance surfaces positioned to divert entrained air carried by the second surface away from the second surface and outwardly toward edges of the second surface.

In accordance with still another feature of the present invention, the second dynamic pressure device may include air guidance surfaces positioned to create a partial vacuum adjacent to the second surface.

In accordance with a still further feature of the present invention, the first dynamic pressure device may include air guidance surfaces positioned to divert entrained air carried by the first surface toward the first surface and outwardly over an area adapted for guiding the paper sheet. Further, the air guidance surfaces of the first dynamic pressure device may be positioned opposite the air guidance surfaces of the second dynamic pressure device and the air guidance surfaces of the first and second dynamic pressure devices may have curved surfaces. Alternatively, the air guidance surfaces of the first dynamic pressure device and the air guidance surfaces of the second dynamic pressure device may be alternatingly positioned and have curved surfaces.

In accordance with yet another feature of the present invention, the device may also include air guidance surfaces located in a vicinity of a paper sheet transfer point and positioned to facilitate lifting force from the belt to the paper sheet transfer point. Further, the air guidance surfaces may be positioned adjacent the first surface and to extend away from the first surface in a belt run direction. Further, the air guidance surfaces may have a curved surface.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted drawing by way of non-limiting example of a preferred embodiment of the present invention, and wherein.

DETAILED DESCRIPTION OF THE PRESENT INVENTION

Figure 1:
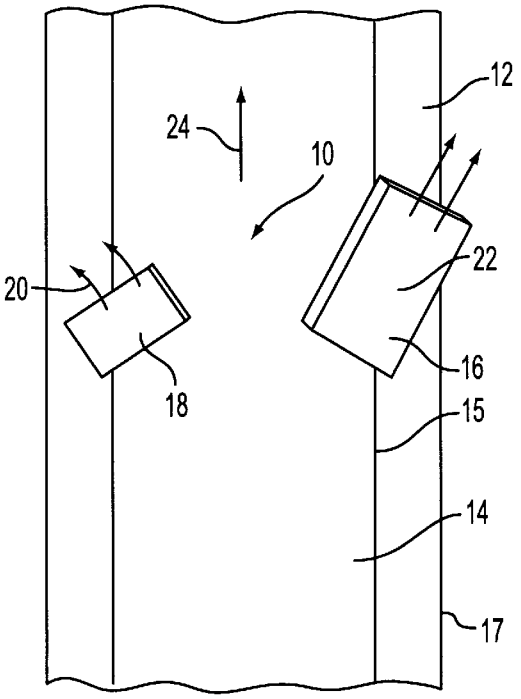
FIG. 1 illustrates a top view of a felt belt guiding a paper sheet and an entrained air deflecting device, in accordance with the present invention, positioned above the paper sheet.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

FIG. 1 illustrates a top view of a belt 12, e.g., a felt belt, and a paper sheet 14 positioned on belt 12. Belt 12 may be utilized to guide paper sheet 14 through the machine. To avoid fluttering of paper sheet 14, and in particular fluttering of the edges 15 of paper sheet 14, a flutter avoidance device 10 may be provided that includes air guidance surfaces 16 and 18.

The present invention utilizes the entrained air running with the surface of moving paper sheet 14 and belt 12 to substantially avoid flutter by paper sheet 14. Particularly, air guidance surfaces 16 and 18 may be formed, e.g., as substantially square sheets, positioned above paper sheet 14 and oriented so that air guidance surfaces 16 and 18 are pointed toward paper sheet 14, in a sheet run direction, and may be rotated diagonally outward in a direction of edges 17 of belt 12. This particular orientation of air guidance surfaces 16 and 18 may direct an air flow, i.e., the entrained air running with the surface of paper sheet 14, in the direction of edges 17, and more particularly, may create or form an air flow of the entrained air toward paper sheet 14 and outwardly over edges 15 of paper sheet 14, as represented by the arrows 20 and 22.

Thus, the tendency of edges 15 to flutter may be significantly reduced by the dynamic pressure created by the deflection of the entrained air current by air guidance surfaces 16 and 18. This created dynamic pressure, thus, concurrently presses paper sheet 14 against belt 12 and deflects the air at edges 15 diagonally outward. For the sake of clarity, air guidance surface 16 is shown in a larger scale than air guidance surface 18 and shown positioned over the edge of paper sheet 15 and the edge of belt 12. However, it is noted that the air guidance surfaces 16 and 18 are generally of substantially similar dimensions.

Since a magnitude of the dynamic pressure increases with higher sheet running speeds, higher dynamic pressures resulting from higher sheet running speeds will substantially reduce the tendency to flutter of paper sheet 14. Air guidance surfaces 16 and 18 may alternatively be positioned to cover or extend over edge of paper sheet 14 and over edge 17 of belt 12. In accordance with the present invention, the air guidance surfaces are generally appropriately formed and arranged on both the right and left side of paper sheet 14.

Figure 2:
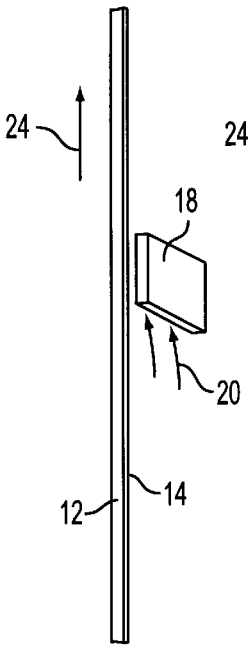
FIG. 2 illustrates a side view of the arrangement depicted FIG. 1.
Figure 3:
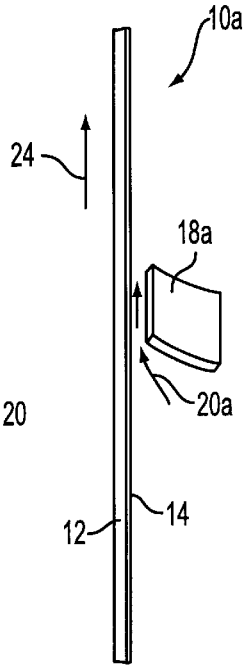
FIG. 3 illustrates an alternative embodiment of the entrained air deflection device in which the air guidance surfaces are curved.

In a preferred modification of the present invention, FIG. 3 illustrates an alternative flutter avoidance device 10*a*. Device 10*a* differs from device 10 depicted in FIG. 1 in that, instead of substantially flat surfaces, the air guidance surfaces of device 10, of which only air guidance surface 18*a* is illustrated, may have substantially curved surfaces. In accordance with this arrangement, an enhanced dynamic pressure may be produced toward paper sheet 14 is produced, as represented by arrows 20*a*. Further, air guidance surfaces 18*a* may be directed or pointed diagonally outward, as discussed above with respect to FIGS. 1 and 2.

The curvature of air guidance surface 18*a* may be optimally adjusted to the flow conditions of the entrained air along the surface of paper sheet 14. In this manner, a higher dynamic pressure may be created or formed than even in the embodiment described with respect to FIGS. 1 and 2. Additionally, this particular arrangement may further reduce the overall tendency of edges 15 of paper sheet 14 to flutter.

Figure 4:
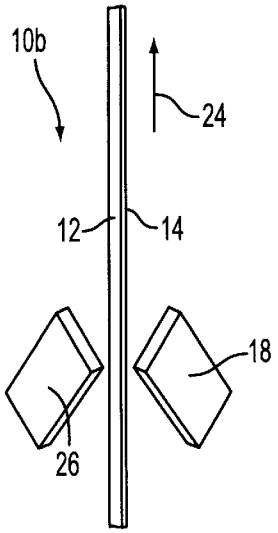
FIG. 4 illustrates another alternative embodiment of the present invention in which entrained air guidance surfaces are located on the felt side.

According to another embodiment of the present invention illustrated in FIG. 4, flutter avoidance device 10*b* is shown. Device 10*b* may differ from devices 10 or 10*a* in that, in addition to positioning air guidance surfaces on the paper sheet side (of which air guidance surface 18 is depicted), second air guidance surfaces (of which air guidance surface 26 is shown) may be positioned on a side of belt 12 opposite the side guiding paper sheet 14. Second air guidance surface 26 may be positioned such that an air stream or current from the entrained air carried by the surface of belt 12 opposite the paper sheet guiding surface is created or formed to point diagonally outward from belt 12. The air stream creates a suction effect beyond or after second air guidance surface 26 in sheet run direction 24. Thus, the suction created on the underside of belt 12 may be utilized to additionally suction paper sheet 14 onto belt 12. Air guidance surface 26 may also be pointed or directed diagonally outward so that the entrained air may be likewise deflected diagonally outward.

Figure 5:
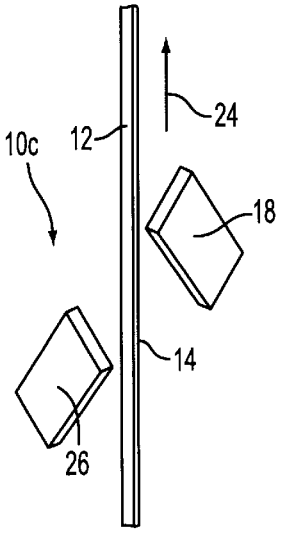
FIG. 5 illustrates still another alternative embodiment of the present invention in which the air guidance surfaces are alternatingly positioned on opposite sides of the belt.

According to another variation of the present invention as shown in FIG. 5, a flutter avoidance device 10*c* is illustrated which differs from device 10*b* in that instead of being positioned opposite each other, the air guidance surfaces 18 and 26 are alternatingly positioned along belt 12.

Figure 6:
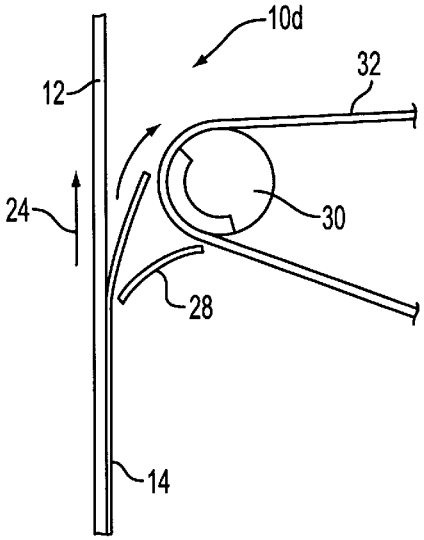
FIG. 6 illustrates yet another embodiment of the present invention in which additional air guidance surfaces are provided on the paper sheet side to produce an outwardly directed suction effect on the sheet.

A further alternative embodiment of the present invention is illustrated in FIG. 6 as flutter avoidance device 10*d*. In this embodiment, third air guidance surfaces 28 may be positioned on the paper sheet guiding side of belt 12 and pointing away from the paper sheet surface in sheet run direction 24. Third air guidance surfaces 28 may be utilized in conjunction with first and second air guidance surfaces 18 and 26 (not shown in FIG. 6), to deflect the entrained air pulled along with paper sheet 14 away from paper sheet 14. This movement of the entrained air creates a suction effect to enhance a lift off tendency of paper sheet 14 from belt 12. In this manner, this embodiment may be particularly useful to facilitate a transfer of a transfer strip to a subsequent unit over which belt 32 may be guided, e.g., a suction roll 30.

It is understood that the illustration in FIG. 6 is purely schematic in nature and that suction roll 30 may generally be moved up to paper sheet 14 so as to facilitate transfer the transfer strip in combination with the suction effect created by air guidance surfaces 28.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A device for guiding a paper sheet on a belt comprising:

first air guidance surfaces located on a paper sheet guiding side of the belt;

the first air guidance surfaces positioned to create a dynamic pressure between the first air guidance surfaces and the paper sheet that presses the paper sheet onto the belt;

the first air guidance surfaces being positioned to extend diagonally toward the paper sheet in a sheet run direction and diagonally outward toward edges of the belt.

2. The device in accordance with claim 1, the air guidance surfaces being extended over an edge of the paper sheet.

3. The device in accordance with claim 1, further comprising second air guidance surfaces located on an other side of the belt opposite the paper sheet guiding side; and the second air guidance surfaces positioned to outwardly deflect air being pulled along by the other side of the belt and to create a vacuum to suction the paper sheet onto the belt.

4. The device in accordance with claim 3, the second air guidance surfaces positioned to extend outwardly from the other side of the belt in a sheet run direction and diagonally to edges of the belt.

5. The device in accordance with claim 4, the first and second air guidance surfaces being positioned opposite each other another.

6. The device in accordance with claim 4, the first and second air guidance surfaces being alternatingly positioned along the belt.

7. The device in accordance with claim 1, further comprising third air guidance surfaces located on the paper sheet guiding side of the belt in a vicinity of an area for transferring the paper sheet to a subsequent unit; and the third air guidance surfaces being positioned to extend from the paper sheet in a sheet run direction.

8. The device in accordance with claim 1, further comprising second air guidance surfaces located on an other side of the belt opposite the paper sheet guiding side;

the second air guidance surfaces positioned to outwardly deflect air being pulled along by the other side of the belt and to create a vacuum to suction the paper sheet onto the belt;

third air guidance surfaces located on the paper sheet guiding side of the belt in a vicinity of an area for transferring the paper sheet to a subsequent unit;

the third air guidance surfaces being positioned to extend from the paper sheet in a sheet run direction; and at least one of the first, second, and third air guidance surfaces comprising curved surfaces.

9. The device in accordance with claim 1, the belt comprising a felt belt.

10. A device for guiding a paper sheet on a belt comprising:

first air guidance surfaces located on a paper sheet guiding side of the belt;

the first air guidance surfaces positioned to create a dynamic pressure between the first air guidance surfaces and the paper sheet that presses the paper sheet onto the belt; and the first air guidance surfaces being positioned adjacent edges of the paper sheet and extending diagonally outward toward edges of the belt to outwardly deflect air being pulled along by the paper sheet to press the paper sheet onto the belt.

11. A flutter avoidance device for use in a machine in which a paper sheet is guided on a moving belt, the belt having a first surface for guiding the paper sheet and a second surface opposite the first surface, the device comprising:

a first dynamic pressure device exerting a dynamic pressure that presses the paper sheet onto the first surface of the belt; and the first dynamic pressure device comprising first air guidance surfaces positioned to extend diagonally toward the paper sheet in a sheet run direction and diagonally outward toward edges of the belt.

12. The flutter avoidance device in accordance with claim 11, the first dynamic pressure device positioned adjacent the first surface.

13. A flutter avoidance device for use in a machine in which a paper sheet is guided on a moving belt, the belt having a first surface for guiding the paper sheet and a second surface opposite the first surface, the device comprising:

a first dynamic pressure device exerting a dynamic pressure that presses the paper sheet onto the first surface of the belt;

the first dynamic pressure device comprising first air guidance surfaces positioned extending diagonally outward toward edges of the belt to divert entrained air carried by the first surface toward the first surface and outwardly over an area adapted for guiding the paper sheet.

14. The flutter avoidance device in accordance with claim 11, further comprising a second dynamic pressure device positioned adjacent the second surface.

15. The flutter avoidance device in accordance with claim 14, the second dynamic pressure device comprising second air guidance surfaces positioned to divert entrained air carried by the second surface away from the second surface and outwardly toward edges of the second surface.

16. The flutter avoidance device in accordance with claim 14, the second dynamic pressure device comprising second air guidance surfaces positioned to create a partial vacuum adjacent to the second surface.

17. The flutter avoidance device in accordance with claim 14, the first air guidance surfaces positioned to divert entrained air carried by the first surface toward the first surface and outwardly over an adapted for guiding the paper sheet.

18. The flutter avoidance device in accordance with claim 17, the first air guidance surfaces being positioned opposite the second air guidance surfaces of the second dynamic pressure device.

19. The flutter avoidance device in accordance with claim 18, the first and second air guidance surfaces having curved surfaces.

20. The flutter avoidance device in accordance with claim 17, the first air guidance surfaces and the second air guidance surfaces being alternatingly positioned.

21. The flutter avoidance device in accordance with claim 20, the first and second air guidance surfaces having curved surfaces.

22. The flutter avoidance device in accordance with claim 11, further comprising transfer air guidance surfaces located in a vicinity of a paper sheet transfer point; and the transfer air guidance surfaces positioned to facilitate lifting force from the belt to the paper sheet transfer point.

23. The flutter avoidance device in accordance with claim 22, the transfer air guidance surfaces being positioned adjacent the first surface and to extend away from the first surface in a belt run direction.

24. The flutter avoidance device in accordance with claim 23, the transfer air guidance surfaces having a curved surface.

25. The flutter avoidance device in accordance with claim 23, the air guidance surfaces having a curved surface.

* * * * *